United States Patent [19]

Himmel et al.

[11] Patent Number: 5,016,606

[45] Date of Patent: May 21, 1991

[54] GAS-FIRED OVEN

[75] Inventors: Robert L. Himmel; Frank E. Parobechek, both of Cleveland, Ohio

[73] Assignee: Gas Research Institute, Chicago, Ill.

[21] Appl. No.: 401,166

[22] Filed: Aug. 31, 1989

[51] Int. Cl.[5] ..... F24C 15/32

[52] U.S. Cl. ..... 126/21 A; 126/21 R; 126/273 R; 126/39 C; 432/152; 432/176; 99/447; 99/474

[58] Field of Search ..... 126/21 A, 21 R, 39 C, 126/273 R; 432/152, 176, 199; 99/447, 474

[56] References Cited

U.S. PATENT DOCUMENTS

| | | | |
|---|---|---|---|
| 3,590,803 | 7/1971 | Sauer | 126/21 A |
| 3,605,717 | 9/1971 | Sauer | 126/21 A |
| 3,991,737 | 11/1976 | Del Fabbro | 126/21 A |
| 4,484,561 | 11/1984 | Baggott et al. | 126/21 A |
| 4,722,683 | 2/1988 | Royer | 126/21 A X |
| 4,813,398 | 3/1989 | Savage | 126/21 A |

*Primary Examiner*—Larry Jones

*Attorney, Agent, or Firm*—Mason, Fenwick & Lawrence

[57] ABSTRACT

A gas-fired oven is disclosed wherein heated air is delivered to an oven's interior from a gas burner located outside the oven in a way to enhance the convection heating properties and capacity of the oven. This is accomplished by means of a conduit which receives air heated by the external gas burner and internally discharges this heated air into the return air path of a blower used to recirculate hot air within the oven. The internal discharge end of the conduit is located adjacent to the blower's return air path so that the conduit does not obstruct the recirculating air. The external gas burner may be either an atmospheric burner or a power burner. Its gas burner head is axially aligned with the conduit's exterior inlet end and spaced a short distance from this inlet. The spacing between the burner head and the conduit inlet controls the dilution air which is required to regulate the temperature of the hot air according to the oven's function such as heating food.

26 Claims, 3 Drawing Sheets

GAS-FIRED OVEN

BACKGROUND OF THE INVENTION

The present invention relates to an oven for heating items such as foods with gas energy, and has particular utility in the cook-chill-rethermalization process. The oven preferably uses the relatively high heat release of natural gas which is burned outside the insulated oven walls, providing uniform high velocity forced air convection heating and high production capacities.

Prior approaches to rethermalization ovens have used heating elements, often electrical in nature, which are placed inside the oven cavity and arranged in geometries that attempt to evenly distribute the heat input to the oven cavity and the food therein. These ovens are characterized by long heating times, wide variations in food temperatures and relatively small capacities. For example, U.S. Pat. No. 4,722,683 (Royer) shows a rethermalization oven whose preferred embodiment employs an electrical heating coil situated in an interior heating chamber, although Royer also suggests the alternative use of a gas flame within the same chamber. U.S. Pat. No. 4,671,250 (Hurley) also provides an interior gas burner which is directly in front of and spaced but a short distance from the interior circulating blower. Similarly, U.S. Pat. No. 4,648,377 (Van Camp) shows a gas flame inside the insulated oven walls for providing hot air to a circulating blower through internal heat exchange tubes that partially block the flow of air from the blower.

In contrast to this prior art wherein combustion occurs inside the oven, the present invention introduces heated air (including combustion products) into the oven from an exterior gas burner via a conduit or "fire tube" in a manner such that the air flow from a recirculating blower within the oven is not blocked nor is its return air flow impeded. Thus, air flow velocities to and from both sides of the oven are nearly identical and provide uniform temperatures within the oven cavity for the food or other items being heated.

SUMMARY OF THE INVENTION

Accordingly, a primary object of the present invention is to provide a gas-fired oven wherein heated air is delivered to the oven's interior from a gas burner located outside the oven in a way to enhance the convection heating properties and capacity of the oven. This is accomplished by means of a conduit or fire tube which receives air heated by the external gas burner and internally discharges this heated air into the return air path of a blower used to recirculate hot air within the oven. In a preferred embodiment of the invention, the internal discharge end of the conduit is centered above the return air path of a radial discharge blower wheel at approximately the same level as the top of the blower wheel so that the conduit end is adjacent the return air path and does not obstruct the recirculating air.

Another important object of the present invention involves the delivery of hot air to the conduit by an exterior gas burner head that is axially aligned with the conduit's exterior inlet end and spaced a short distance from this inlet. The spacing between the burner head and the conduit inlet controls the dilution air which is required to regulate the temperature of the hot air according to the oven's function such as heating food.

A further object of the present invention is to use either an atmospheric gas burner or a power gas burner as the external heat source for the oven described herein. An atmospheric burner costs less than a power burner while still producing about the same results.

These and other objects, advantages and capabilities of the present invention will become apparent from the following detailed description, taken in conjunction with the accompanying drawings, that illustrate preferred embodiments of the invention.

DETAILED DESCRIPTION OF THE PREFERRED EMBODIMENTS

Figure 1:
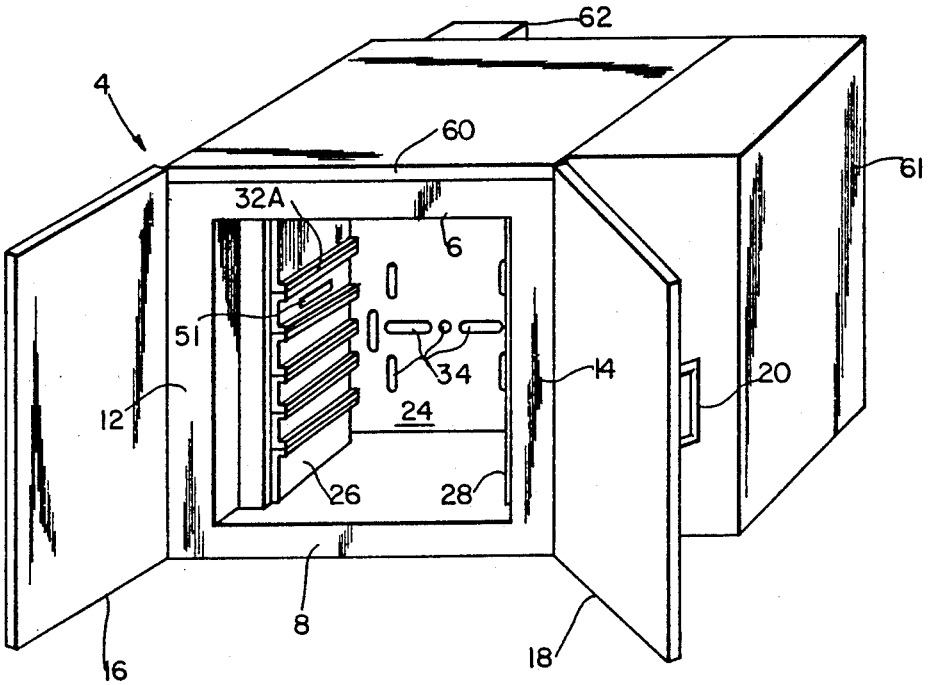
FIG. 1 is a front perspective view of a rethermalization oven in which the present invention is incorporated.

In describing the preferred embodiments of the subject invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Referring first to one preferred embodiment shown in FIGS. 1 through 4, the present invention has particular utility in a rethermalization oven 2 for heating and/or cooking food products and the like which is somewhat similar to the oven described in the prior art [U.S. Pat. No. 4,722,683 (Royer)]. The oven includes a housing 4 having a top wall 6, bottom wall 8, rear wall 10 (FIGS. 3 and 4) and two side walls 12, 14 which define a chamber open at the front end of the housing. A pair of doors 16, 18 define the front wall of the housing and are pivotally connected with the housing side walls by hinges 16A and 18A (FIG. 3) to provide access and to close the housing chamber. Each door includes a handle 20 for opening and closing the same, and a locking latch (not shown) may be provided to maintain the doors in the closed position. The housing walls and doors are preferably formed of heat insulating materials.

Figure 3:
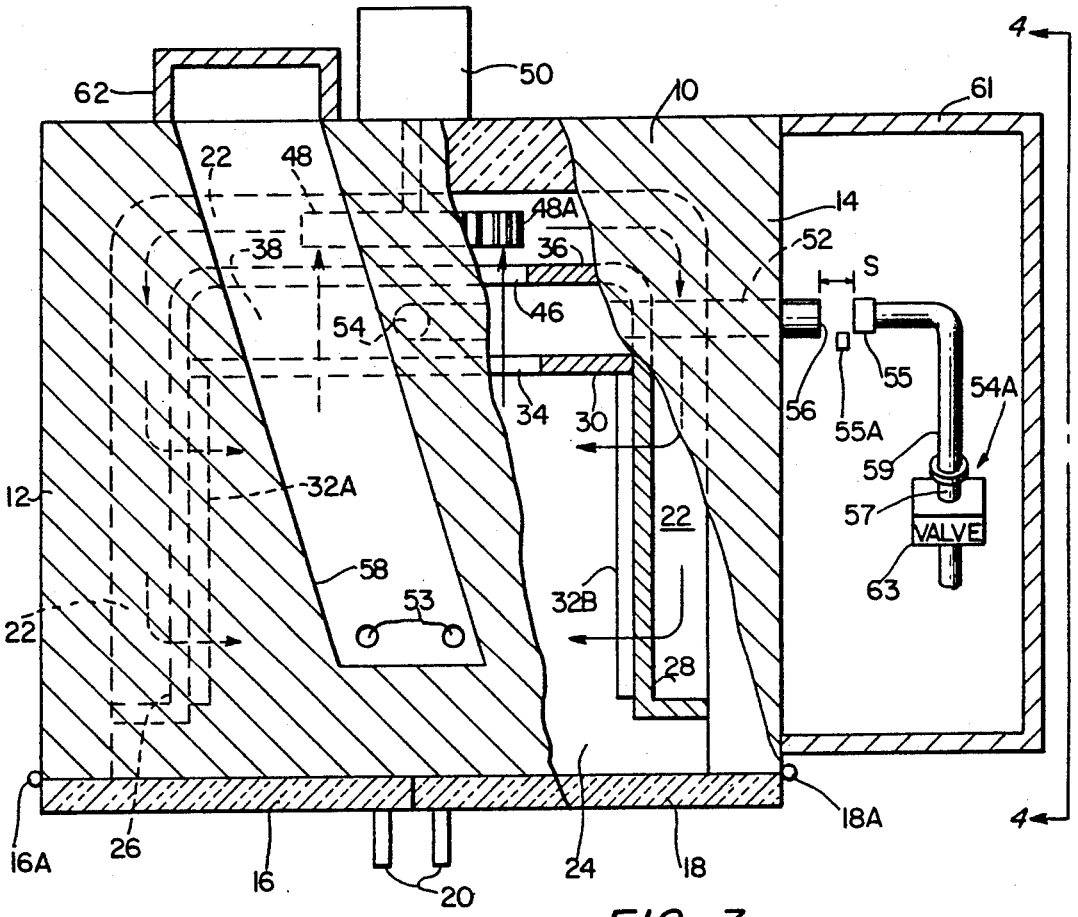
FIG. 3 is a sectional plan view of the FIG. 2 (and FIG. 3) oven taken along line 3—3.

As best shown in FIG. 3, the housing 4 contains a first partition (comprising panels 26, 28 and 30) which separates the chamber into first portion 22 and second portion 24. As will be developed in greater detail below, the first chamber portion 22 acts as an air supply chamber or plenum and the second chamber portion 24 acts as a food heating chamber. The first partition has a generally U-shaped horizontal cross-sectional configuration, whereby the air plenum 22 is U-shaped and extends between the top 6, bottom 8, rear 10 and side 12, 14, walls of the housing and the first partition. The term "air" as used in this description and the appended claims is also intended to encompass other gases including combustion products.

The first partition includes a pair of spaced parallel side panels 26, 28 connected between the top and bottom walls of the housing and respectively parallel to and spaced from the housing side walls 12 and 14. The first partition also includes a rear panel 30 extending between the housing top and bottom walls and arranged normal to the first partition side panels and spaced from the housing rear wall 10. The opposite ends of the rear panel 30 are connected with the side panels 26 and 28 by any suitable means such as welding.

Figure 2:
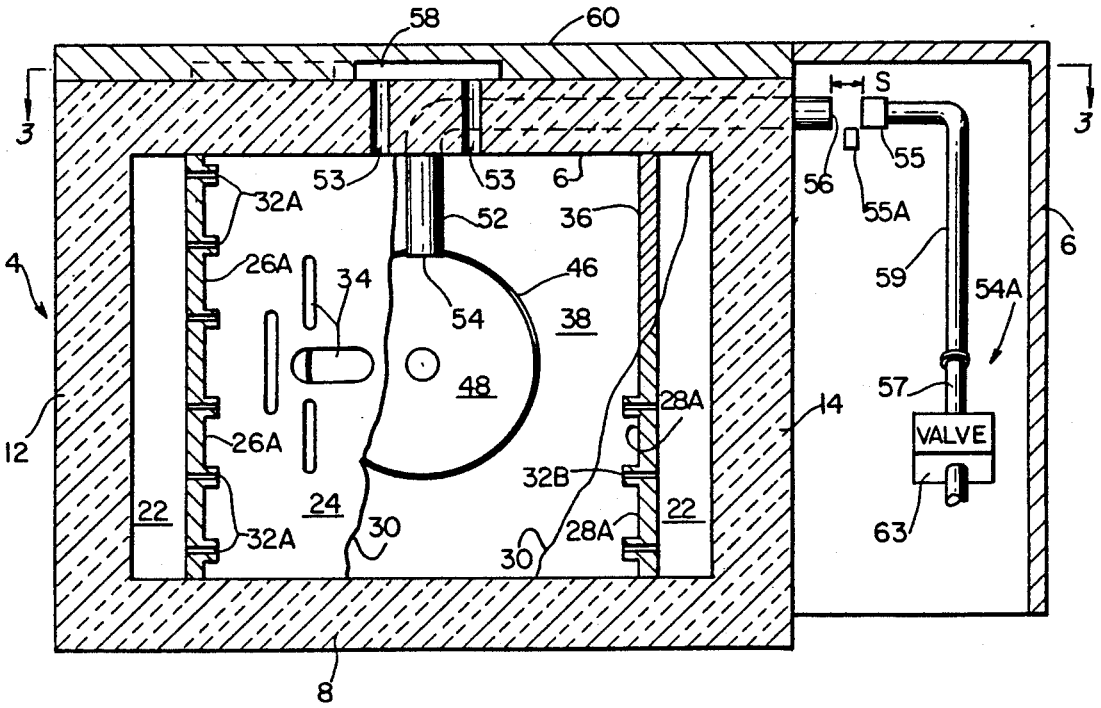
FIG. 2 is a partially cut-away front elevation view of the interior of the oven of FIG. 1 which shows one preferred embodiment of the present invention using an external atmospheric gas burner that delivers hot air to a conduit entering the oven at one side.

The first partition side panels 26 and 28 may comprise a plurality of vertically spaced C-shaped panels 26A and 28A, respectively, as shown more particularly in FIG. 2. The spaces between panels 26A and 28A comprise horizontal through-slots 32A and 32B, respectively, with the slots of one side panel being arranged opposite corresponding slots in the other side panel. A portable rack carrier having supports for food racks (not shown) can be arranged within the cooking chamber portion 24 upon which containers of food to be heated are supported between the side panel slots 32.

Referring again to FIG. 3, the partition rear panel 30 contains one or more openings 34 which are generally arranged in the vertical central portion of the panel. A second dividing partition 36, having a generally U-shaped horizontal cross-sectional configuration, is connected with the housing top 6 and bottom 8, and is positioned between and spaced apart from the housing rear wall 10 and rear panel 30 to define a compartment 38 behind the rear panel openings 34 as shown in FIG. 3. As will be developed below, compartment 38 is where exteriorly heated air is introduced into the oven.

The second dividing partition 36 also contains at least one opening 46 that preferably is centrally located and permits air flow between the compartment 38 and the air plenum 22. A vertically disposed radial discharge blower wheel 48, such as a squirrel cage centrifugal blower with an outer circle of radial vanes 48A, is adjacent and parallel to the housing rear wall 10 and arranged within the rear of air plenum 22 so that its axial return air inlet faces the opening 46 in the second partition 36. Blower wheel 48 and opening 46 have approximately the same outer diameter in the illustrated embodiment. A motor 50 outside the oven rotates the blower 48. Operation of the blower delivers air to the left and right sides of air plenum chamber portion 22 and thence to the heating chamber portion 24 via the slots 32A and 32B in the first partition side panels 26 and 28. Air exits the heating chamber portion 24 through the first partition rear panel openings 34 to the compartment 38. Heated air from compartment 38 is drawn by the low-pressure axial inlet of blower 48 through the divider opening 46 for recirculation to the air plenum.

The oven so far described is nearly identical to the Royer oven in U.S. Pat. No. 4,722,683, except for not specifically showing the blower scroll, baffles and related components of Royer which, if desired, could be added to the oven disclosed herein for the purposes stated by Royer. A conventional thermostat 51 and its control system, as described by Royer, can also be included to sense the temperature of the heating chamber and to control the operation of the oven. In the instant oven, as well as in Royer, air is forced over and under food pans in heating chamber 24 by blower 48, with this air flow being directed radially outward by the blower along the rear 10 of the oven, then forward in plenum 22 and through slots 32 in side panels 26 and 28 into chamber portion 24 before being returned to the blower's inlet via the openings in rear panel 30 and partition 36. This return air has been reduced in temperature because of heat transfer to the pans of food.

Royer heats his oven air by means of either an electric coil heating element or a gas burner located within the compartment 38. However, the present invention improves over the teachings of Royer and other presently known prior art in the manner in which the temperature is raised within the oven. This is performed by heated air delivered to the oven from a gas burner assembly located outside the oven, as will now be described.

Figure 4:
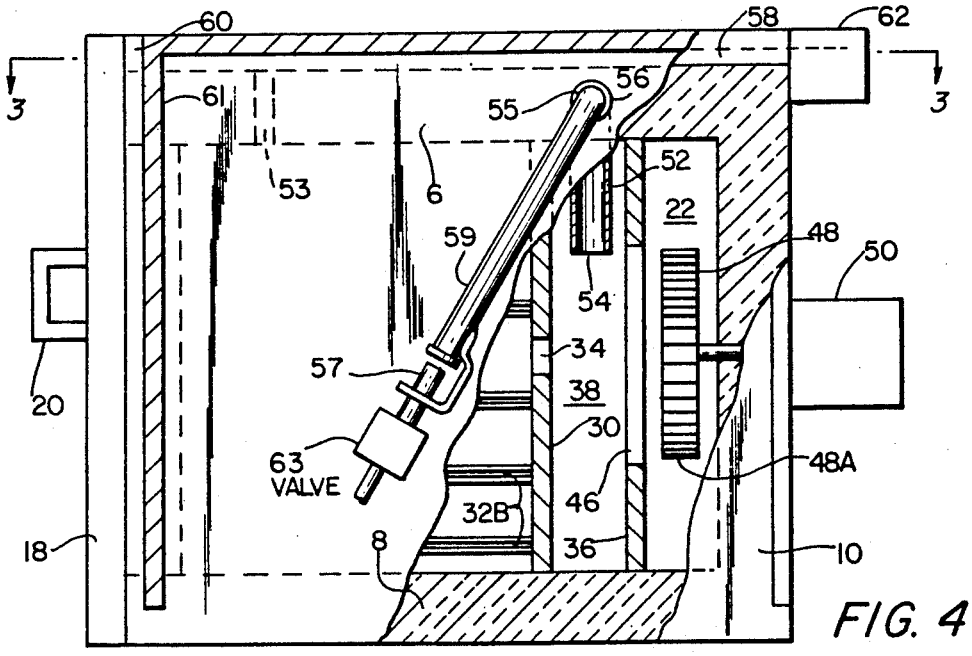
FIG. 4 is a partially cut-away side elevation view of the FIG. 3 oven taken along line 4—4.

As best shown in FIGS. 2 and 4, an open-ended conduit or "fire tube" 52 horizontally enters the side of the oven housing near its top and runs through the top insulating wall 6. This conduit then bends and partially extends downward into the compartment 38 so that the conduit's discharge end 54 preferably is centered above the blower's return air path through compartment 38 and is at approximately the same level as the top edge of the opening 46 and the top edge of blower wheel 48. Thus, the conduit discharge end 54 is adjacent to rather than appreciably extending into the blower's return air path. As will therefore be observed, the discharge air flow from the blower 48 to the oven's left and right sides is not blocked by conduit 52, nor is the blower's return air path impeded by the downwardly extending conduit 52 which preferably terminates at about the diameter of the illustrated blower wheels, including down to about the inside diameter of vanes 48A. This arrangement insures that air flow velocities to and from both sides of the oven are nearly identical so as to provide uniform temperatures within the oven chamber portion 24 for the food being cooked or rethermalized. If desired, the conduit discharge end 54 can also be positioned around the blower return air path at locations other than at the top of the oven, such as at the side or bottom of the oven.

In FIGS. 1 through 4, the hot air is delivered to the fire tube 52 by an atmospheric gas burner assembly 54A located outside the oven housing, which is supplied with natural gas or other gaseous fuel such as propane through valve 63. If desired, assembly 54A may be at least partially enclosed by a cover 61. The gaseous fuel from valve 63 is discharged through a burner orifice 57 and thence through burner pipe 59 to a burner head 55. Adjacent to burner head 55 is a flame igniter 55A of any well-known type for establishing a gas flame at this burner head. As best shown in FIGS. 2 and 3, the atmospheric burner head 55 of assembly 54A is axially aligned with and spaced apart from the exterior inlet end 56 of the conduit 52. The spacing distance "S" between the burner head 55 and the inlet 56 of fire tube 52, which may be made variable, controls the dilution air required to regulate the temperature of the heated air to a value needed to heat food or other items. With the atmospheric burner, this spacing also controls the secondary air for maximum efficiency, complete combustion and the required flame length. A spacing distance of about 2" (5 cm) was utilized in one operative version of this oven.

The oven shown in FIGS. 1 through 4 also provides an induced draft to vent gases therefrom. One or more openings 53 are provided in the oven top 6 which vent gaseous products from the cooking chamber portion 24 to a shallow flueway 58 (FIGS. 2 and 4) that is angled from front-to-back within a top cover plate 60 (FIGS. 2 and 3). Flueway 58 terminates in a flue box 62 (FIGS. 3 and 4) that discharges these vented gases at the rear of the oven. The induced draft action is created by the negative pressure at the inlet to the blower 48 which circulates the hot gases into the oven's cooking chamber portion 24.

Figure 5:
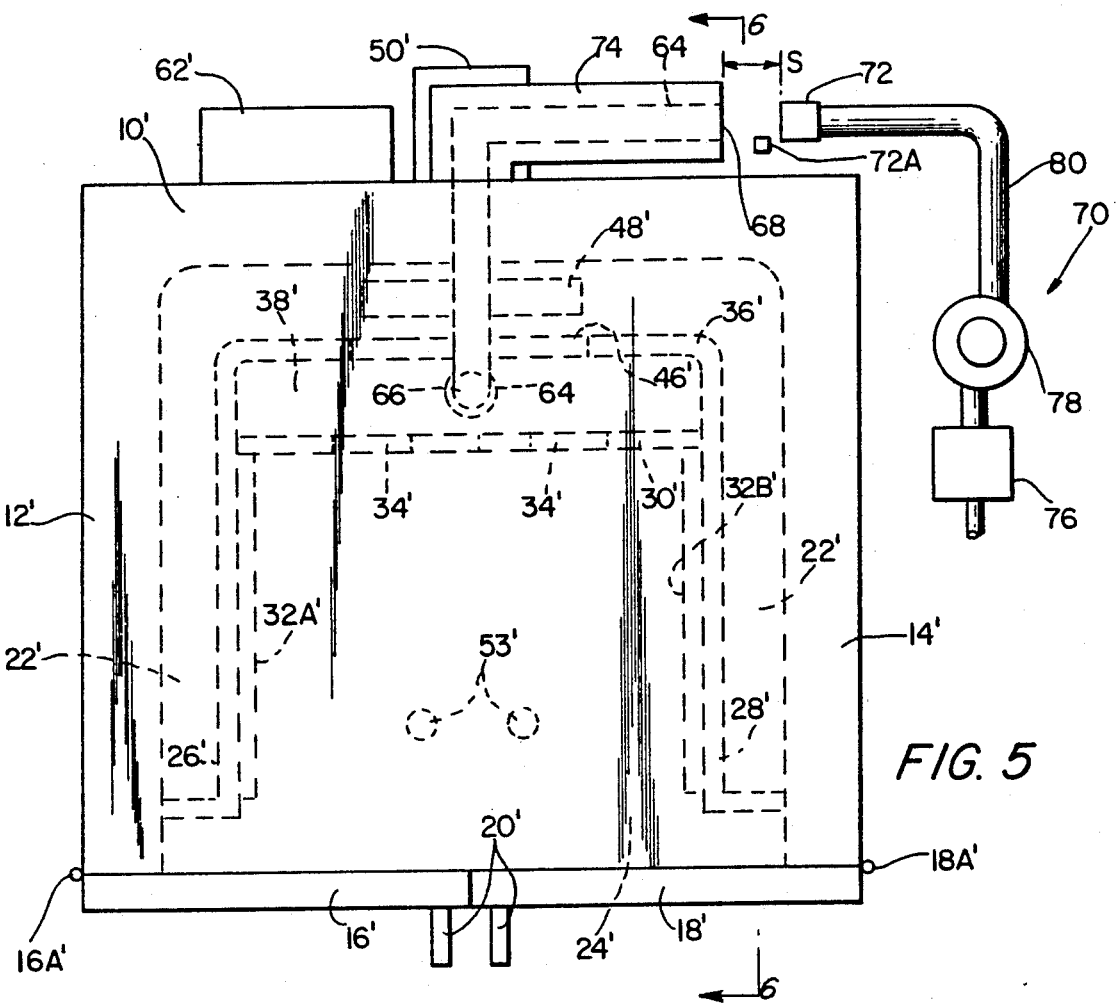
FIG. 5 is a plan view of an alternative preferred embodiment of the present invention using an external power gas burner which delivers hot air to a conduit entering the oven at its rear.
Figure 6:
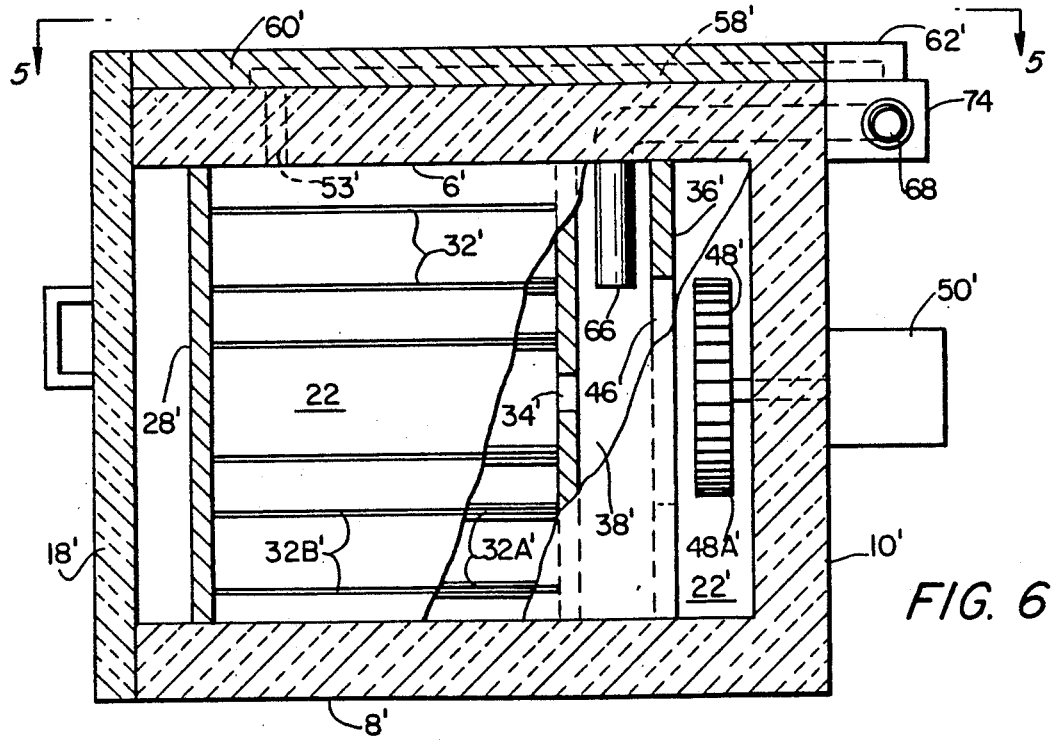
FIG. 6 is a partially cut-away side elevation view of the FIG. 5 oven taken along line 6—6.

One particular advantage in using the atmospheric gas burner assembly 54A is that this configuration costs less than other types of gas burners while still meeting all performance goals for the improved oven. However, an exterior gas power burner assembly that burns a pressurized mixture of air and fuel gas may also be advantageously used to deliver hot air and combustion products via a conduit, or fire tube, to the return air side of the oven's blower 48. A preferred embodiment of this alternative power burner configuration is shown in FIGS. 5 and 6, and employs a conduit or fire tube 64 that enters the rear of the oven near its top rather than through the oven's side as shown in the previously described FIGS. 1 through 4. However, a side entry fire tube may also be used with a power burner and a rear entry fire tube may be used with the atmospheric burner.

Primed numbers in FIGS. 5 and 6 identify components that are identical to components in FIGS. 1 through 4 labelled with similar unprimed numbers. In FIGS. 5 and 6, the entering horizontal fire tube 64 also bends to extend preferably downward into a compartment 38' to approximately the level of the top edge of blower 48' so that the conduit discharge end 66 is centered above and adjacent to the return air path of this blower. Hot air is provided at the exterior inlet opening 68 of fire tube 64 by a conventional gas power burner assembly 70, preferably supplied with natural gas through valve 76, whose burner head 72 (with adjacent igniter 72A) is axially aligned with the fire tube 64 and spaced a short distance "S" from the inlet 68. As with the atmospheric burner embodiment, this distance "S" between inlet 68 and head 72 may be varied depending on input and other factors. Burner head 72 is supplied with a pressurized primary air-fuel gas mixture from a standard pre-mix unit 78 via a pipe 80.

In an actual operating power burner embodiment of FIGS. 5 and 6 that was sized for a large capacity load, the conduit or fire tube 64 was 3" (7.6 cm) in diameter and the burner head 72 was spaced about ½" (1.3 cm) from inlet 68. The power burner assembly 70 operated at 90,000 Btu/hr and provided a controlled flame approximately 12" (30.5 cm) long that extend into fire tube 64 but which did not enter the oven cavity. The flame length is a function of the draw of the burner but should be as short as possible.

The use of a power burner assembly provides for the positive control of the primary air, a relatively short flame length, a positive flow velocity into the fire tube, and an efficiency exceeding 50%. Dilution air required to regulate the temperature of the heated air in order to be compatible with heating food or other items is controlled by the spacing "S" between the burner head 72 and fire tube inlet 68. The regulation of the primary and dilution air in the described manner also regulates and controls the volumetric heat release rate for optimum oven pre-heat and production capacity. The exterior length of fire tube 68 may be insulated by an appropriate material 74 to minimize heat losses and maximize thermal efficiency. If desired, power burner assembly 70 can also be enclosed by a cover (now shown).

The design of the novel atmospheric burner and power burner ovens according to the invention permits internal air velocities of about 2500 ft/min to be obtained with a nominal 12" diameter blower wheel operating a 1725 RPM. The ovens according to the invention have also demonstrated their ability to function in the standard forced convection oven cooking mode for the front end of the cook-chill-rethermalization process with equal or better heat distribution, efficiency and production capacity as compared to other conventional forced convection cooking ovens which typically operate at air velocities of 300 ft/min to 600 ft/min. In practice, the present invention permits the design of an oven which, for example, will accommodate ten steam table pans, each 12"×20"×2½" deep. As one example of its utility, an oven of this size will rethermalize 150 pounds of chilled (34° F. through 37° F.) food, such as macaroni and cheese, to an average temperature of 160° F. in about 45 minutes. The present invention also allows a modular oven design to permit expansion to a larger unit by, for example, placing one oven housing on top of another oven housing with a common horizontal wall therebetween, and delivering heated air to each oven housing from a common exterior gas burner.

From the above, it is apparent that many modifications and variations of the present invention are possible in light of the above teachings. It is therefore to be understood that, within the scope of the appended claims, the invention may be practiced otherwise than as specifically described.

What is claimed is:

1. A gas-fired oven, comprising:

a housing including walls defining a chamber;

partition means arranged within said housing chamber for separating said chamber into at least a first portion and a second portion in which items such as food products can be placed to be heated, said partition means having openings to permit air flow between said first and second chamber portions;

blower means located within said first chamber portion for discharging and circulating air within said first chamber portion through at least one of said partition openings into said second chamber portion, said blower means further having a return air inlet for drawing air through at least another one of said partition openings in a return air path from said second chamber portion;

air conduit means for directing air to said blower return air inlet, said air conduit means extending only partially into said first chamber portion and having an open inlet end outside said housing chamber and a discharge end inside said first chamber portion adjacent to said blower return air path; and gas flame source means located outside said housing chamber for producing heated air at said conduit inlet end which flows through said conduit means into said first chamber portion.

2. An oven according to claim 1, which further includes flue means for venting air from said second chamber portion.

3. An oven according to claim 1, wherein said gas flame source means comprises an atmospheric gas burner.

4. An oven according to claim 3, wherein said atmospheric gas burner includes a burner head that is axially aligned with and spaced apart from said conduit inlet end.

5. An oven according to claim 4, wherein the distance said burner head is spaced apart from said conduit inlet end is variable.

6. An oven according to claim 3, which further includes flue means for venting air from said second chamber portion.

7. An oven according to claim 1, wherein said gas flame source means comprises a power gas burner.

8. An oven according to claim 7, wherein said power gas burner includes a burner head that is axially aligned with and spaced apart from said conduit inlet end.

9. An oven according to claim 1, wherein said conduit discharge end is adjacent to said blower return air path.

10. An oven according to claim 1, wherein said blower means comprises a radial discharge blower wheel substantially disposed in a vertical direction and wherein said conduit means extends downward within said first chamber portion and said conduit discharge end is at approximately the same level as the top of said blower wheel.

11. A gas-fired oven, comprising:

a housing including top, bottom, front, first side, second side and rear walls defining a chamber;

partition means arranged within said housing chamber for separating said housing chamber into at least first and second portions, said partition means comprising:

(1) opposed first and second side panels spaced from said first and second housing side walls, respectively, for defining a first part of said first chamber portion therebetween, said first and second side panels each containing at least one opening therethrough, and (2) a rear panel spaced from said housing rear wall for defining a second part of said first chamber portion therebetween, said rear panel being connected with said first and second side panels to define said second chamber portion between said first and second side panels and said housing front wall in which items such as food products can be placed to be heated, said rear panel also containing at least one opening therethrough;

blower means located within said first chamber portion between said housing rear wall and said partition rear panel for discharging and circulating air within said first chamber portion through said partition side panel openings into said second chamber portion, said blower means further having return air inlet means for drawing air through said partition rear panel opening in a return air path from said second chamber portion;

an air conduit extending only partially into said first chamber portion and having an open inlet end outside said housing chamber and a discharge end inside said first chamber portion, said air conduit entering said first chamber portion behind said partition rear panel, and said conduit discharge end being adjacent to said blower return air path; and gas flame source means located outside said housing chamber for producing heated air at said conduit inlet end which flows through said air conduit into said blower return air path.

12. An oven according to claim 11, which further includes flue means for venting air from said second chamber portion.

13. An oven according to claim 11, wherein said gas flame source means comprises an atmospheric gas burner.

14. An oven according to claim 13, wherein said atmospheric gas burner includes a burner head that is axially aligned with and spaced apart from said conduit inlet end.

15. An oven according to claim 14, wherein the distance said burner head is spaced apart from said conduit inlet end is variable.

16. An oven according to claim 13, which further includes flue means for venting air from said second chamber portion.

17. An oven according to claim 11, wherein said gas flame source means comprises a power gas burner.

18. An oven according to claim 17, wherein said power gas burner includes a burner head that is axially aligned with and spaced apart from said conduit inlet end.

19. An oven according to claim 11, wherein said blower means comprises a radial discharge blower wheel substantially disposed in a vertical direction with an axial return air inlet facing said partition rear panel opening, and wherein said air conduit extends downward within said first chamber portion and said conduit discharge end is centered above said blower return air path at approximately the same level as the top of said blower wheel.

20. A gas-fired oven, comprising:

a housing including top, bottom, front, side and rear walls defining a chamber;

partition means arranged within said housing chamber for separating said chamber into at least first and second portions, said partition means comprising:

(1) opposed first and second side panels spaced from said first and second housing side walls, respectively, for defining a first part of said first chamber portion therebetween, said first and second side panels each containing at least one opening therethrough, and (2) a rear panel spaced from said housing rear wall for defining a second part of said first chamber portion therebetween, said rear panel being connected with said first and second side panels to define said second chamber portion between said first and second panels and said housing front wall in which items such as food products can be placed to be heated, said rear panel also containing at least one opening therethrough;

divider panel means located in said first chamber portion between and in spaced relation with said housing rear wall and said partition rear panel for defining a compartment behind said rear panel opening, said divider panel means containing at least one centrally located opening therethrough;

radial discharge blower wheel means substantially disposed in a vertical direction and located within said first chamber portion between said housing rear wall and said divider panel means for circulating air within said first chamber portion through said partition side panel openings into said second chamber portion and further having an axial return air inlet facing said divider panel opening for drawing air through said compartment in a return air path from said second chamber portion;

an air conduit extending only partially into said compartment and having an open inlet end outside said housing chamber and a discharge end inside said compartment adjacent to said blower return air path; and atmospheric gas burner means located outside said housing chamber which includes a burner head that is axially aligned with and spaced apart from said conduit inlet end for producing heated air which flows through said air conduit into said compartment.

21. An oven according to claim 20, which further includes flue means for venting air from said second chamber portion.

22. An oven according to claim 20, wherein said gas burner means comprises an atmospheric gas burner.

23. An oven according to claim 22, which further includes flue means for venting air from said second chamber portion.

24. An oven according to claim 22, wherein the distance said burner head is spaced apart from said conduit inlet end is variable.

25. An oven according to claim 20, wherein said gas burner means comprises a power gas burner.

26. An oven according to claim 20, wherein said air conduit extends downward within said compartment and said conduit discharge end is centered above said blower return air path and is at approximately the same level as the top of said blower wheel.

* * * * *